US011619408B2

(12) United States Patent
Zhang et al.

(10) Patent No.: US 11,619,408 B2
(45) Date of Patent: Apr. 4, 2023

(54) METHOD AND DEVICE OF COMBINING OUTDOOR UNITS AND ROTATING OPERATION OF OUTDOOR UNITS AND MSAC SYSTEM

(71) Applicant: Gree Electric Appliances, Inc. of Zhuhai, Guangdong (CN)

(72) Inventors: Shiqiang Zhang, Guangdong (CN); Huachao Jiao, Guangdong (CN); Jianguo Xiong, Guangdong (CN); Lianfa Wu, Guangdong (CN)

(73) Assignee: Gree Electric Appliances, Inc. of Zhuhai, Guangdong (CN)

( * ) Notice: Subject to any disclaimer, the term of this patent is extended or adjusted under 35 U.S.C. 154(b) by 310 days.

(21) Appl. No.: 16/979,588

(22) PCT Filed: Dec. 14, 2018

(86) PCT No.: PCT/CN2018/120998
§ 371 (c)(1),
(2) Date: Sep. 10, 2020

(87) PCT Pub. No.: WO2019/184457
PCT Pub. Date: Oct. 3, 2019

(65) Prior Publication Data

US 2021/0003305 A1 Jan. 7, 2021

(30) Foreign Application Priority Data

Mar. 30, 2018 (CN) ..... 201810292362.0

(51) Int. Cl.
*F24F 11/30* (2018.01)
*F24F 11/65* (2018.01)
(Continued)

(52) U.S. Cl.
CPC ..... *F24F 11/30* (2018.01); *F24F 11/65* (2018.01); *F24F 11/54* (2018.01); *F24F 11/88* (2018.01);
(Continued)

(58) Field of Classification Search
CPC .. F24F 11/30; F24F 11/65; F24F 11/54; F24F 11/88; F24F 2140/50; F24F 2140/60; F25B 49/027; F25B 49/022
See application file for complete search history.

(56) References Cited

U.S. PATENT DOCUMENTS 5,797,729 A * 8/1998 Rafuse, Jr. ..... F04C 28/08 62/126
7,854,138 B2 * 12/2010 Hwang ..... F25B 49/022 62/226
(Continued)

FOREIGN PATENT DOCUMENTS

CN 1072492 A 5/1993
CN 1702408 A 11/2005
(Continued)

OTHER PUBLICATIONS

Translation and numbering of CN-101178192-A.*

*Primary Examiner* — Mohammad Ali
*Assistant Examiner* — Vincent W Chang
(74) *Attorney, Agent, or Firm* — The Webb Law Firm

(57) ABSTRACT

The present disclosure relates to a method and device of combining outdoor units and rotating operation of outdoor units, and MSAC system, and relates to the field of unit technology. The method includes: determining a plurality of combination manners of the outdoor units, according to a capacity of an indoor unit currently turned on and a capacity of each of the outdoor units; sequencing the plurality of combination manners in priority, according to priority strat-
(Continued)

egies; and sequentially rotating the outdoor units to operate, based on the sequenced combination manners.

15 Claims, 3 Drawing Sheets

(51) Int. Cl.
*F24F 140/60* (2018.01)
*F24F 140/50* (2018.01)
*F24F 11/88* (2018.01)
*F24F 11/54* (2018.01)

(52) U.S. Cl.
CPC ..... *F24F 2140/50* (2018.01); *F24F 2140/60* (2018.01)

(56) References Cited

U.S. PATENT DOCUMENTS

| | | | | |
|---|---|---|---|---|
| 10,838,441 | B2 * | 11/2020 | Ostrye | F24F 11/46 |
| 2002/0134094 | A1 | 9/2002 | Huh et al. | |
| 2005/0149232 | A1 * | 7/2005 | Shah | F24F 11/54 700/276 |
| 2006/0059931 | A1 * | 3/2006 | Petterson | F25B 49/022 62/175 |
| 2016/0161165 | A1 * | 6/2016 | Ushijima | F25B 30/02 62/155 |
| 2017/0292763 | A1 * | 10/2017 | Douglas | G05B 15/02 |
| 2018/0094824 | A1 * | 4/2018 | Ostrye | F24F 11/83 |
| 2018/0283752 | A1 * | 10/2018 | Yoon | F25B 49/02 |
| 2019/0163213 | A1 * | 5/2019 | Ostrye | F24F 11/65 |
| 2021/0003305 | A1 | 1/2021 | Zhang et al. | |

FOREIGN PATENT DOCUMENTS

| | | | | |
|---|---|---|---|---|
| CN | 1719140 | A | | 1/2006 |
| CN | 1782573 | A | | 6/2006 |
| CN | 101178192 | A | * | 5/2008 |
| CN | 101178192 | A | | 5/2008 |
| CN | 102207698 | A | | 10/2011 |
| CN | 102353122 | A | | 2/2012 |
| CN | 103307698 | A | | 9/2013 |
| CN | 103512154 | A | | 1/2014 |
| CN | 104390308 | A | | 3/2015 |
| CN | 105588271 | A | | 5/2016 |
| CN | 105605842 | A | | 5/2016 |
| CN | 108613327 | A | | 10/2018 |
| DE | 3832037 | A1 | | 3/1990 |
| EP | 1600710 | A2 | | 11/2005 |
| EP | 1666818 | A2 | | 6/2006 |
| JP | 2002181370 | A | | 6/2002 |
| JP | 2013221623 | | | 10/2013 |
| JP | 2013221623 | A | | 10/2013 |
| JP | 2017101881 | A | | 6/2017 |
| KR | 1020070107260 | A | | 11/2007 |

* cited by examiner

METHOD AND DEVICE OF COMBINING OUTDOOR UNITS AND ROTATING OPERATION OF OUTDOOR UNITS AND MSAC SYSTEM

CROSS-REFERENCE TO RELATED APPLICATIONS

This application is the United States national phase of International Application No. PCT/CN2018/120998 filed Dec. 14, 2018, and claims priority to Chinese Patent Application No. 201810292362.0 filed Mar. 30, 2018, the disclosures of which are hereby incorporated by reference in their entirety.

BACKGROUND OF THE INVENTION

Field of the Invention

The present disclosure relates to the field of unit technology, and in particular to a method of combining outdoor units and rotating operation of outdoor units, a device of combining outdoor units and rotating operation of outdoor units, a MSAC (Multiple-split air conditioning) system, and a non-transitory computer-readable storage medium.

Description of Related Art

Generally, in order to increase the effective operation life of the MSAC system and avoid excessive operation and loss of individual outdoor unit, the MSAC of various manufacturers are designed with a module rotating solution for switching a start sequence of each outdoor unit during operation.

In the related art, a mechanical rotating solution is used. For example, the start sequence of a previous cycle is an outdoor unit 1, an outdoor unit 2, and an outdoor unit 3, and the rotation of a next cycle consists in the outdoor unit 2, the outdoor unit 3, the outdoor unit 1, and so forth.

SUMMARY OF THE INVENTION

According to some embodiments of the present disclosure, a method of combining outdoor units and rotating operation of outdoor units, comprising: determining a plurality of combination manners of the outdoor units, according to a capacity of an indoor unit currently turned on and a capacity of each of the outdoor units; sequencing the plurality of combination manners in priority, according to priority strategies; and sequentially rotating the outdoor units to operate, based on the sequenced combination manners.

In some embodiments, the determining a plurality of combination manners of the outdoor unit according to a capacity of an indoor unit currently turned on and a capacity of each of the outdoor units includes: determining a range of a total capacity of the outdoor unit according to a capacity of the indoor unit currently turned on; determining a plurality of combination manners of the outdoor unit according to the range of a total capacity of the outdoor unit and the capacity of each of the outdoor units.

In some embodiments, the determining a range of a total capacity of the outdoor unit according to a capacity of the indoor unit currently turned on is achieved by the following formula: $Q/b \leq Qcb \leq Q/a$; where Q is a capacity of the indoor unit currently turned on, Qcb is a total capacity of the outdoor unit, a and b are preset values, $0<a<b<1$.

In some embodiments, the determining a plurality of combination manners of the outdoor unit according to the range of a total capacity of the outdoor unit and the capacity of each of the outdoor units includes: determining the capacity of each of the outdoor units, using any one or more outdoor units to obtain a plurality of combination manners, and calculating a sum of capacities of the outdoor unit in each combination manner, such that a combination manner in which the sum of capacities of the outdoor unit is within a range of the total capacity of the outdoor unit is determined as a final combination manner of the outdoor unit.

In some embodiments, the priority strategies include that: a combination manner with minimum outdoor units has a highest priority; if there are a plurality of combination manners that satisfy a minimum number of the outdoor unit, a sum of capacities of the outdoor unit in each combination manner is calculated, and a combination manner in which the sum of capacities of the outdoor unit is maximum has a highest priority; if there are a plurality of combination manners that satisfy a minimum number of the outdoor unit and a maximum sum of capacities of the outdoor unit, a combination manner with a minimum communication address of the outdoor unit has a highest priority.

In some embodiments, the method further comprises: supplementing the outdoor unit that is not involved in each combination manner into a combination manner according to sequencing strategies to form a plurality of new combination manners, after sequencing the plurality of combination manners in priority according to the priority strategies; wherein each of the new combination manners involves all the outdoor units; a sequence of the outdoor unit not involved in the new combination manners is located after the outdoor unit that has been involved; the sequencing strategies include: sequencing in a descending order according to a capacity; and sequencing in an ascending order according to a communication address if the capacity is the same.

In some embodiments, the step of shifting the outdoor unit to operate based on the sequenced combination manners comprises that: each of the outdoor units is sequentially operated in each combination manner according to a sequence, wherein an operation duration of each of the outdoor units is a preset duration; after a plurality of combination manners have been completed in operation, each of the outdoor units is sequentially operated in each combination manner again and such cycle continues until shutdown.

In some embodiments, the method further comprises that: when it is monitored that a capacity Q of the indoor unit currently turned on changes, it is determined whether the capacity Q of the current indoor unit is the same as a capacity Q' of the indoor unit turned on at a previous moment; if they are the same, then it is determined whether an cumulative operation duration of a combination manner currently in operation has reached the preset duration such that if so, a next combination manner is operated, if not, a current combination manner continues to be operated; if they are different, then a new combination manner is calculated according to the capacity Q of the current indoor unit, and it is determined whether the new combination manner is the same as the combination manner currently in operation; if they are the same, it is determined whether an accumulated operation duration has reached the preset duration such that if it is reached, a next combination manner will be operated, and if it is not reached, a new combination manner will continue to be operated; if they are different, an operation will be switched to a new combination manner.

In other embodiments of the present disclosure, a device of combing outdoor units and rotating operation of outdoor units is provided. The device comprises: a combination module configured to determines a plurality of combination manners of the outdoor unit according to a capacity of an indoor unit currently turned on and a capacity of each of the outdoor units; a sequencing module configured sequence the plurality of combination manners in priority according to priority strategies; an operation module configured to sequentially shift the outdoor unit to operate based on the sequenced combination manner.

In some embodiments, the combination module includes: a range determining unit configured to determine a range of a total capacity of the outdoor unit according to a capacity of the indoor unit currently turned on; a combination determining unit configured to determine a plurality of combination manners of the outdoor unit according to a range of a total capacity of the outdoor unit and a capacity of each of the outdoor units.

In some embodiments, the range determining unit determines a range of a total capacity Qcb of the outdoor unit by the following formula: $Q/b \leq Qcb \leq Q/a$; where Q is a capacity of the indoor unit currently turned on, Qcb is a total capacity of the outdoor unit, a and b are preset values, $0<a<b<1$.

In some embodiments, the combination module includes: a capacity determining unit configured to determine a capacity of each of the outdoor units; a combination unit configured to combine any one or more outdoor units to obtain a plurality of combination manners; and a selecting unit configured to calculate a sum of capacities of the outdoor unit in each combination manner, such that a combination manner in which the sum of capacities of the outdoor unit is within a range of a total capacity of the outdoor unit is determined as a final combination manner of the outdoor unit.

In some embodiments, the priority strategies include that: a combination manner with minimum outdoor units has a highest priority; if there are a plurality of combination manners that satisfy a minimum number of the outdoor unit, a sum of capacities of the outdoor unit in each combination manner is calculated, and a combination manner in which the sum of capacities of the outdoor unit is maximum has a highest priority; if there are a plurality of combination manners that satisfy a minimum number of the outdoor unit and a maximum sum of capacities of the outdoor unit, a combination manner with a minimum communication address of the outdoor unit has a highest priority.

In some embodiments, the device further comprises: a combination optimizing module configured to supplement the outdoor unit that is not involved in any combination manner into each combination manners according to sequencing strategies to form a plurality of new combination manners; wherein each of the new combination manners involves all the outdoor units; a sequence of the outdoor unit not involved in the new combination manners is located after the outdoor unit that has been involved; the sequencing strategies include: sequencing in a descending order according to a capacity; and sequencing in an ascending order according to a communication address if the capacity is the same.

In some embodiments, the operation module is configured to sequentially operate each of the outdoor units in each combination manner according to a sequence, wherein an operation duration of each of the outdoor units is a preset duration; after a plurality of combination manners have been completed in operation, each of the outdoor units is sequentially operated in each combination manner again and such cycle continues until shutdown.

In some embodiments, the device further comprises: a monitoring operation module configured such that: when it is monitored that a capacity Q of the indoor unit currently turned on changes, it is determined whether the capacity Q of the current indoor unit is the same as a capacity Q' of the indoor unit turned on at a previous moment; if they are the same, then it is determined whether an cumulative operation duration of a combination manner currently in operation has reached the preset duration such that if so, a next combination manner is operated, and if not, a current combination manner continues to be operated; if they are different, then a new combination manner is calculated according to the capacity Q of the current indoor unit, and it is determined whether the new combination manner is the same as the combination manner currently in operation; if they are the same, it is determined whether an accumulated operation duration has reached the preset duration such that if it is reached, a next combination manner will be operated, and if it is not reached, a new combination manner will continue to be operated; if they are different, an operation will be switched to a new combination manner.

According to further embodiments of the present disclosure, a MSAC system is provided. The system comprises the device of combining outdoor units and rotating operation of outdoor units according to any one of the embodiments described above.

According to still other embodiments of the present disclosure, a combination shift operation device of an outdoor unit is provided. The device comprises: a memory; and a processor coupled to the memory, wherein the processor is configured to perform the method of combining outdoor units and rotating operation of outdoor units according to any one of the embodiments described above based on instructions stored in the memory.

According to still other embodiments of the present disclosure, a non-transitory computer-readable storage medium is provided. A computer program is stored on the medium, wherein the program when executed by a processor implements the method of combining outdoor units and rotating operation of outdoor units according to any one of the embodiments described above.

Other features and advantages of the present disclosure will become apparent from the following detailed description of exemplary embodiments of the present disclosure with reference to the accompanying drawings.

BRIEF DESCRIPTION OF THE DRAWINGS

The drawings described herein are used to provide a further understanding of the present disclosure and constitute a part of the present disclosure. The illustrative embodiments of the present disclosure as well as the descriptions thereof, which are used for explaining the present disclosure, do not constitute improper definitions on the present disclosure. In the accompanying drawings.

DESCRIPTION OF THE INVENTION

Figure 1:
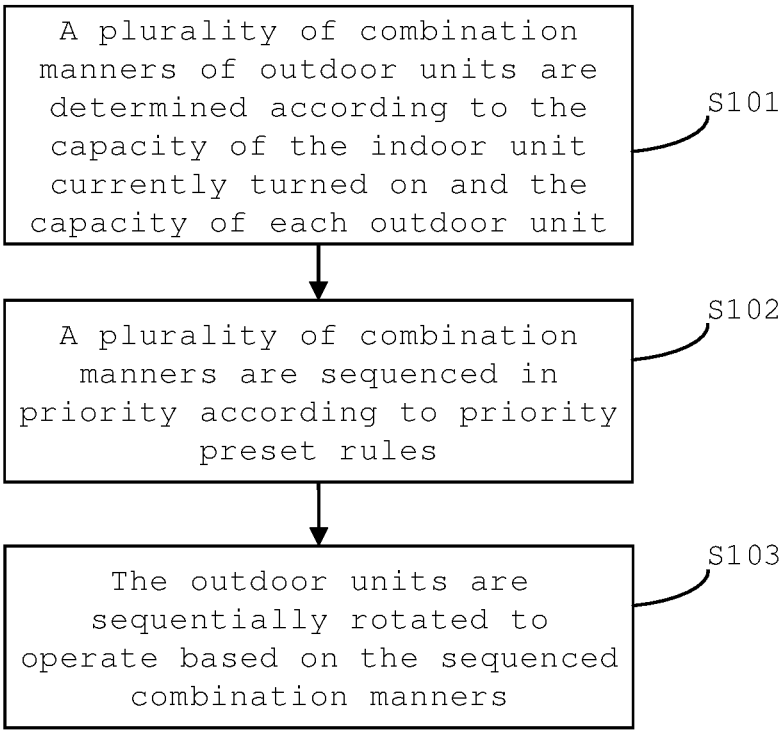
FIG. 1 is a flowchart of a method of combining outdoor units and rotating operation of outdoor units according to some embodiments of the present disclosure.

Next, the technical solution in the embodiments of the present disclosure will be explicitly and completely described in combination with the drawings in the embodiments of the present disclosure. Apparently, the described embodiments are merely part of the embodiments of the present disclosure, rather than all the embodiments. The following descriptions of at least one exemplary embodiment which are in fact merely descriptive, by no means serve as any delimitation on the present disclosure as well as its application or use. On the basis of the embodiments of the present disclosure, all the other embodiments acquired by a person skilled in the art on the premise that no inventive effort is involved fall into the scope protected by the present disclosure.

Unless additionally specified, the relative arrangements, numerical expressions and numerical values of the components and steps expounded in these examples do not limit the scope of the present disclosure. At the same time, it should be understood that, in order to facilitate the description, the dimensions of various parts shown in the drawings are not delineated according to actual proportional relations. The techniques, methods, and apparatuses known to a common technical person in the relevant art may not be discussed in detail, but where appropriate, techniques, methods, and apparatuses should be considered as part of the granted description. Among all the examples shown and discussed here, any specific value should be construed as being merely illustrative, rather than as a delimitation. Thus, other examples of exemplary embodiments may have different values. It should be noted that similar reference signs and letters present similar items in the following drawings, and therefore, once an item is defined in a drawing, there is no need for further discussion in the subsequent drawings.

The inventors of the present disclosure have found that the above-described related art has the following problems: when MSAC outdoor units with different capacities are combined together and operating in partial load, the energy efficiency of the whole machine under different combination manners is different. Such mechanical rotation without considering the advantages and disadvantages of the energy efficiency of the whole machine, is not conducive to exert an optimal energy efficiency of the system at partial load, and the operation cost is relatively high. In view of this, the present disclosure proposes a technical solution of combination rotating operation of the outdoor unit, which is favorable for exerting an optimal energy efficiency of the system and reduce the operation cost.

FIG. 1 shows a flowchart of a method of combining outdoor units and rotating operation of outdoor units according to some embodiments of the present disclosure.

As shown in FIG. 1, the method includes the following processes (steps S101-step S103): in step S101, a plurality of combination manners of outdoor units are determined according to the capacity of the indoor unit currently turned on and the capacity of each outdoor unit; in step S102, a plurality of combination manners are sequenced in priority according to priority strategies; in step S103, the outdoor units are sequentially rotated to operate based on the sequenced combination manners.

By applying a new combination and rotation solution of the outdoor units provided in the present embodiment, it is possible to improve the energy efficiency of the system during operation at partial load, achieve the purpose of saving the operation cost whilst ensuring optimal cooling and heating effects, and prolong an effective service life of the unit.

In the present embodiment, the step of determining a plurality of combination manners of the outdoor units according to the capacity Q of the indoor unit currently turned on and the capacity of each outdoor unit, may be implemented by the following embodiment: the range of the total capacity Qcb of the outdoor units is determined according to the capacity Q of the indoor unit currently turned on; a plurality of combination manners of the outdoor units are determined according to the range of the total capacity Qcb of the outdoor units and the capacity of each outdoor unit. On such basis, the combination of the outdoor units is performed after the capacity of the indoor unit turned on and the capacity of each outdoor unit are weighed, so that it is possible to effectively improve the energy efficiency of the system.

When the range of the total capacity Qcb of the outdoor units is determined, it may be achieved by the following formula: $Q/b \leq Qcb \leq Q/a$; where a and b are preset values, $0<a<b<1$. Considering the energy efficiency of the system, in some embodiments a is set to 0.5 and b is set to 0.75. Since the total capacity of the outdoor unit is Qcb, under normal circumstances, the system has the highest energy efficiency when operating at a load rate ranging 50% to 75%. That is, the values of a and b are determined by the energy efficiency of the system, but not limited thereto, and the values of a and b are set for the purpose of achieving an optimal energy efficiency of the system.

After the range of the total capacity Qcb of the outdoor units is determined, the capacity of each outdoor unit is determined, any one or more outdoor units are combined to obtain a plurality of combination manners, and the sum of the capacities of the outdoor units in each combination manner is calculated, such that the combination manner in which the sum of the capacities of the outdoor units is within the range of the total capacity of the outdoor units is determined as the final combination manner of the outdoor unit. In other words, among a plurality of combination manners finally determined, each combination manner includes one or more outdoor units, and the sum of the capacities of the outdoor units included in each combination manner needs to conform to the range of the total capacity Qcb of the outdoor units, thereby achieving the purpose of improving the energy efficiency of the system.

In the following, introduction will be made by examples. Assume that there are four outdoor units in the MSAC system, wherein the capacities of the outdoor units A, B, C, and D are 8HP, 10HP, 14HP, and 22HP respectively. If the capacity Q of the indoor unit turned on is 20HP, the range of Qcb is determined to be 26HP-40HP. Then, a plurality of combination manners that meet the requirements are shown in Table 1.

TABLE 1

| Module 1 | Module 2 | Module 3 | Module 4 |
|---|---|---|---|
| 22 | 14 | | |
| 22 | 10 | | |
| 22 | 8 | | |
| 22 | 10 | 8 | |

Each row in Table 1 is a combination manner: the combination manner in the first row includes module 1

(outdoor unit D) and module 2 (outdoor unit C); the combination manner in the second row includes module 1 (outdoor unit D) and module (outdoor unit B); the combination manner in the third row includes module 1 (outdoor unit D) and module 2 (outdoor unit A); the combination manner in the fourth row includes module 1 (outdoor unit D) and module 2 (outdoor unit B) and module 3 (outdoor unit A).

Of course, if there is no combination manner to meet the requirements of the above-described range, the rotating operation will be performed according to a traditional mechanical sequence.

After a plurality of combination manners are determined, there is a need to sequence a plurality of combination manners in priority. During implementation, sequencing may be performed according to the following priority strategy: the combination manner with minimum number of outdoor units has the highest priority; if a plurality of combination manners are satisfied, the sum of the capacities of the outdoor units in each combination manner is calculated and the combination manner in which the sum of the capacities of the outdoor units is maximum has the highest priority; if there are a plurality of combination manners that meet the requirements of a maximum sum of the capacities of the outdoor units, the combination manner with a minimum communication address of the outdoor unit has the highest priority. Each outdoor unit corresponds to a communication address. In the above-described example, the combination manner with a minimum number of outdoor units has the highest priority first. There are three combination manners with a minimum number of outdoor units: DC, DB and DA, all with two outdoor units in these three combination manners; and the combination manner with three outdoor units is DBA. After that, the combination manners with a maximum sum of the capacities are continued to be combined in priority. Then, the priority sequence of the above-described three combination manners is: DC→DB→DA.

When a plurality of combination manners of outdoor units are determined based on the range of the total capacity Qcb of the outdoor units, considering the limitation of the sum of the capacities, the combination manner may not necessarily encompass all outdoor units, so that it is necessary to supplement the outdoor units that are not involved in any combination manner into the combination manners according to the sequencing strategies to form a plurality of new combination manners; wherein each of the new combination manners involves all the outdoor units; the combination position of the outdoor units not involved is located after the outdoor units involved; the sequencing strategies include: sequencing in a descending order according to the capacity; and sequencing in an ascending order according to the communication address if the capacity is the same. On such basis, each combination manner encompasses all the outdoor units, and each combination manner represents a sequencing manner of all the outdoor units.

In the above-described example, it is necessary to supplement the outdoor units not involved in the combination manners: in the combination manner of DC, A and B are absent, and A and B are sequenced: B→A according to the capacity, so that the new combination manner after supplementation is: DCBA; the priority is the first level: Qcb_1; in the combination manner of DB, A and C are absent, and A and C are sequenced: C→A according to the capacity size, so that the new combination manner after supplementation is: DBCA; the priority is the second level: Qcb_2; in the combination manner of DA, B and C are absent, and B and C are sequenced: C→B according to the capacity, so that the new combination manner after supplementation is: DACB; the priority is the third level: Qcb_3; in the combination of DBA, C is absent, and is thus directly added by following DBA, so that the new combination after the supplementation is: DBAC; the priority is the fourth level: Qcb_4.

After all the supplementations are completed, the four combination manners are shown in Table 2, and each combination encompasses four outdoor units.

TABLE 2

| Module 1 | Module 2 | Module 3 | Module 4 | Priority |
|---|---|---|---|---|
| 22 | 14 | 10 | 8 | Qcb_1 |
| 22 | 10 | 14 | 8 | Qcb_2 |
| 22 | 8 | 14 | 10 | Qcb_3 |
| 22 | 10 | 8 | 4 | Qcb_4 |

Each row in Table 2 is a supplemented combination manner, and the rotating operation sequence of the four supplemented combination manners is: cycled according to a sequence of Qcb_1→Qcb_2→Qcb_3→Qcb_4→Qcb_1.

So far, the present embodiment has provided a plurality of combination manners and sequencing in priority is performed. After that, the outdoor units may be rotated to operate according to the sequenced combination manners. For example, each outdoor unit in each combination manner is sequentially operated according to the sequence. Wherein, the operation duration of each outdoor unit is a preset duration, which may be set or adjusted according to the rotation of the outdoor units. For example, each outdoor unit is set to operate for 10 minutes. Of course, description is made here only by an example, and the specific value may be set initiatively. After all the combination manners have been completed in operation, each outdoor unit in each combination manner is sequentially operated again, and such cycle continues until shutdown. Based on the combination rotation solution described above, it is possible to effectively improve the energy efficiency of the system during the rotation operation of the outdoor units, and save the operation cost.

Figure 2:
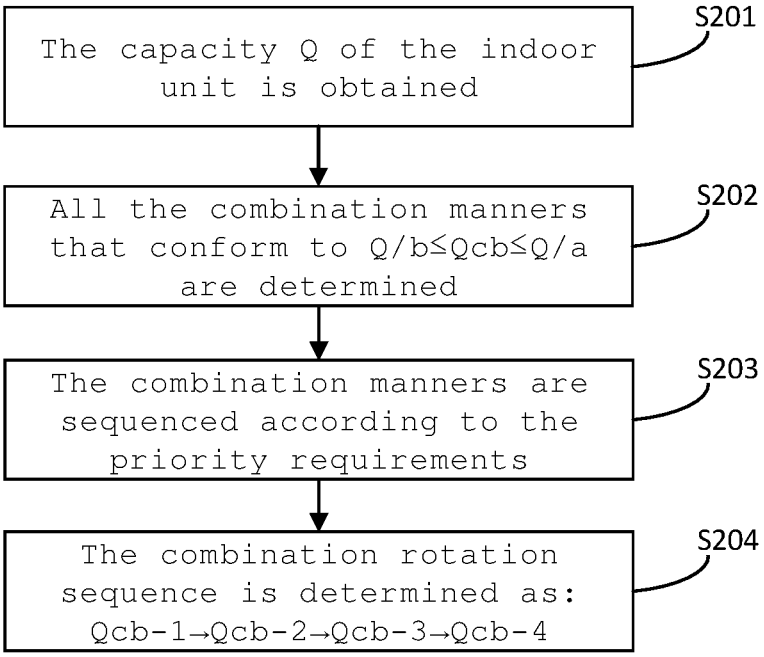
FIG. 2 is a flowchart of determining an energy-efficient combination manner according to some embodiments of the present disclosure.

FIG. 2 is a flowchart of determining an energy-efficient combination manner according to some embodiments of the present disclosure. As shown in FIG. 2, the process includes the following steps (steps S201-step S204): in step S201, the capacity Q of the indoor units is obtained; in step S202, all the combination manners that conform to $Q/b \leq Qcb \leq Q/a$ are determined; in step S203, the combination manners are sequenced according to the priority requirements; in step S204, the combination rotation sequence is determined as: Qcb_1→Qcb_2→Qcb_3→Qcb_4.

During the combination rotating operation of the outdoor units, if the capacity of the indoor unit currently turned on changes, since the startup capacities of different indoor units correspond to different rotation combination manners, it is necessary to determine a rotation manner according to the following method: when it is monitored that the capacity Q of the indoor unit currently turned on changes, it is determined whether the capacity Q of the current indoor unit is the same as the capacity Q' of the indoor units turned on at a previous moment; if they are the same, then it is determined whether the cumulative operation duration of the combination manner currently in operation has reached the preset duration such that if so, the next combination manner is operated, and if not, the current combination manner continues to be operated; if they are different, then a new combination manner is calculated according to the capacity Q of the current indoor unit, and it is determined whether the new combination manner is the same as the combination manner currently in operation; if they are the same, it is determined whether the accumulated operation duration has reached the preset duration; if it is reached, the next combination manner will be operated; if it is not reached, the new combination manner will continue to be operated; if they are different, the operation will be switched to a new combination manner.

Figure 3:
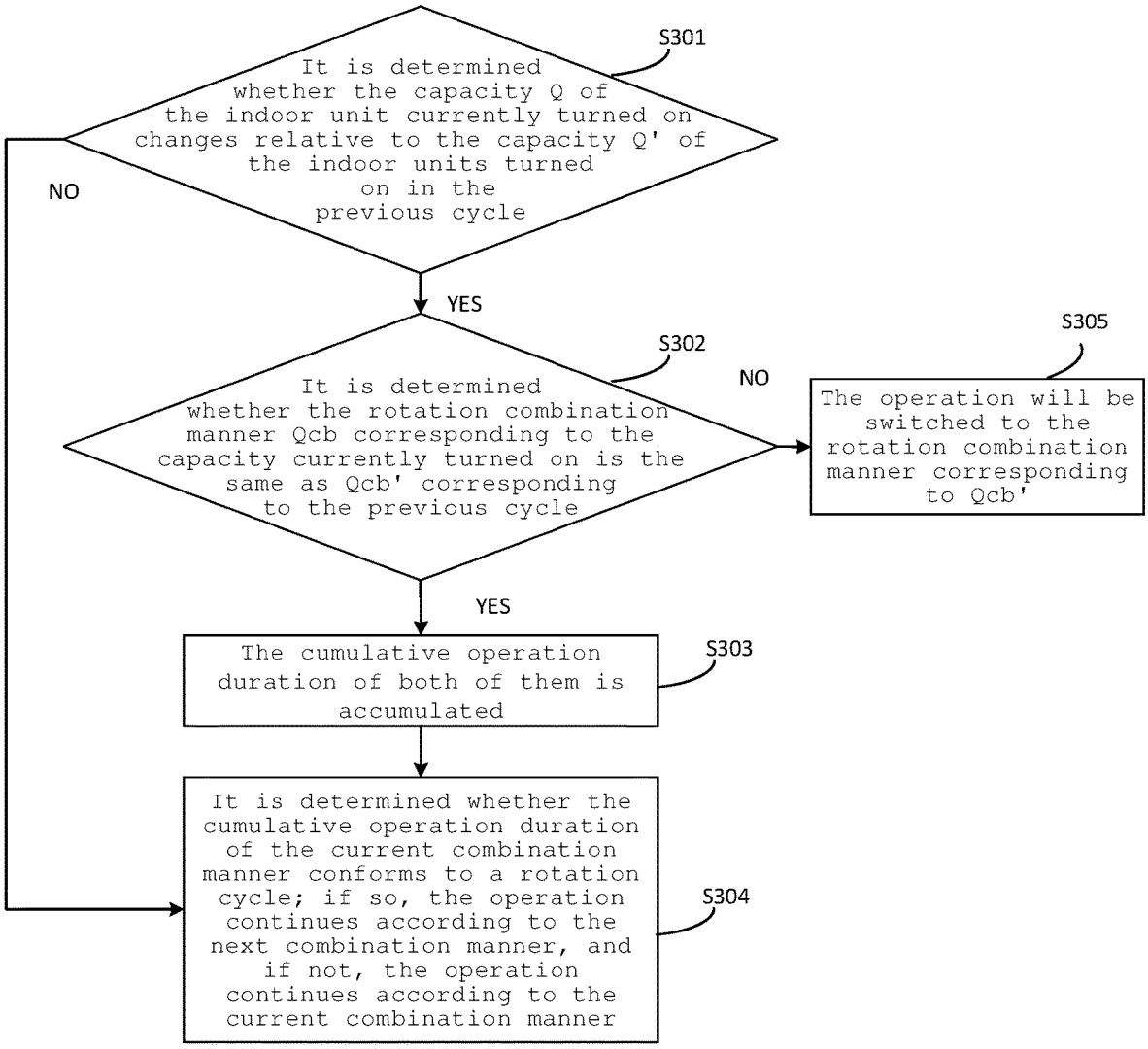
FIG. 3 is a flowchart of a rotation of an energy-efficient combination manner according to some embodiments of the present disclosure.

FIG. 3 is a flowchart of a rotation of an energy-efficient combination manner according to some embodiments of the present disclosure. As shown in FIG. 3, the process includes the following steps (steps S301-S305): in step S301, it is determined whether the capacity Q of the indoor unit currently turned on changes relative to the capacity Q' of the indoor unit turned on in the previous cycle; such that if so, step S302 is performed; and if not, step S304 is performed; in step S302, it is determined whether the rotation combination manner Qcb corresponding to the capacity currently turned on is the same as Qcb' corresponding to the previous cycle; such that if so, then step S303 is performed; and if not, step S305 is performed; in step S303, the cumulative operation duration of both of them is accumulated; in step S304, it is determined whether the cumulative operation duration of the current combination manner conforms to a rotation cycle; such that if so, the operation continues according to the next combination manner; and if not, the operation continues according to the current combination manner; in step S305, the operation will be switched to the rotation combination manner corresponding to Qcb'.

On such basis, it may be guaranteed that when the indoor unit turned on changes, the combination manner in operation is readily adjusted, thereby ensuring an optimal energy efficiency of the system.

Corresponding to the combination and rotating operation method of outdoor units described above, the present embodiment also provides a combination rotation operation device of outdoor units.

Figure 4:
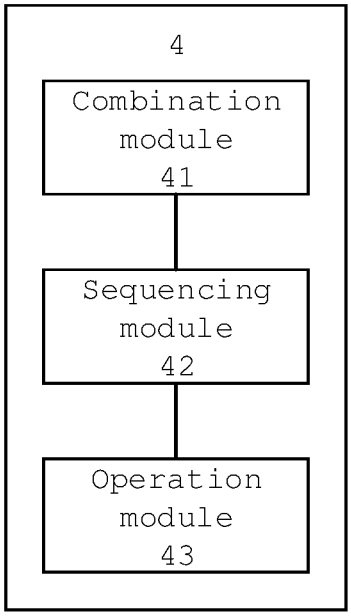
FIG. 4 is a structural block view of a device of combining outdoor units and rotating operation of outdoor units according to some embodiments of the present disclosure.

FIG. 4 is a structural block view of a device of combining outdoor units and rotating operation of outdoor units according to some embodiments of the present disclosure. The combination rotating operation device 4 of the outdoor units includes: a combination module 41 configured to determines a plurality of combination manners of the outdoor unit according to the capacity Q of the indoor unit currently turned on and a capacity of each outdoor unit; a sequencing module 42 configured sequence the plurality of combination manners in priority according to the priority strategies; an operation module 43 configured to sequentially rotating the outdoor unit to operate based on the sequenced combination manner.

By applying a new combination and rotating solution of the outdoor unit provided in the present embodiment, it is possible to improve the energy efficiency of the system during operation at partial load, achieve the purpose of saving the operation cost whilst ensuring optimal cooling and heating effects, and prolong an effective service life of the unit.

In some embodiments, the above-described combination module includes: a range determining unit configured to determine the range of the total capacity Qcb of the outdoor unit according to the capacity Q of the indoor unit currently turned on; a combination determining unit configured to determine a plurality of combination manners of the outdoor unit according to the range of the total capacity Qcb of the outdoor unit and the capacity of each outdoor unit. On such basis, the combination of the outdoor unit is performed after the capacity of the indoor unit turned on and the capacity of each outdoor unit are weighed, so that it is possible to effectively improve the energy efficiency of the system.

The above-described range determining unit may determine the range of the total capacity Qcb of the outdoor unit by the following formula: $Q/b \leq Qcb \leq Q/a$; where a and b are preset values, $0<a<b<1$. Considering the energy efficiency of the system, in some embodiments a is set to 0.5 and b is set to 0.75. Since the total capacity of the outdoor unit is Qcb, under normal circumstances, the system has the highest energy efficiency when operating at a load rate ranging 50% to 75%. That is, the values of a and b are determined by the energy efficiency of the system, but not limited thereto, and the values of a and b are set for the purpose of achieving an optimal energy efficiency of the system.

The above-described combination module includes: a capacity determining unit configured to determine the capacity of each outdoor unit; a combination unit configured to combine any one or more outdoor units to obtain a plurality of combination manners; and a selecting unit which calculates the sum of the capacities of the outdoor units in each combination manner, such that the combination manner in which the sum of the capacities of the outdoor units is within the range of the total capacity of the outdoor unit is determined as the final combination manner of the outdoor unit. In other words, among a plurality of combination manners finally determined, each combination manner includes one or more outdoor units, and the sum of the capacities of the outdoor units included in each combination manner needs to conform to the range of the total capacity Qcb of the outdoor unit, thereby achieving the purpose of improving the energy efficiency of the system.

It should be noted that the priority strategies involved in the present embodiment include: the combination manner with minimum outdoor units has the highest priority; if a plurality of combination manners are satisfied, the sum of the capacities of the outdoor units in each combination manner is calculated and the combination manner in which the sum of the capacities of the outdoor units is maximum has the highest priority; if there are a plurality of combination manners that meet the requirements of a maximum sum of the capacities of the outdoor units, the combination manner with a minimum communication address of the outdoor unit has the highest priority.

The above-described device further comprises: a combination optimizing module configured to supplement the outdoor units that are not involved in any combination manner into the combination manners according to the sequencing strategies to form a plurality of new combination manners; wherein each of the new combination manners involves all the outdoor units; the combination position of the outdoor units not involved is located after the outdoor units involved; the sequencing strategies include: sequencing in a descending order according to the capacity; and sequencing in an ascending order according to the communication address if the capacity is the same. On such basis, each combination manner encompasses all the outdoor units, and each combination manner represents a sequencing manner of all the outdoor units.

The above-described operation module is configured to sequentially operate each outdoor unit in each combination manner according to the sequence. Wherein, the operation duration of each outdoor unit is a preset duration. After all the combination manners have been completed in operation, each outdoor unit in each combination manner is sequentially operated again, and such cycle continues until shutdown. Based on the combination rotation solution described above, it is possible to effectively improve the energy efficiency of the system during the rotating operation of the outdoor unit, and save the operation cost.

Considering how to ensure the energy efficiency of the system when the capacity of the indoor unit turned on changes, in the present embodiment, the above-described device further comprises: a monitoring operation module configured such that it is determined whether the capacity Q of the current indoor unit is the same as the capacity Q' of the indoor unit turned on at a previous moment when it is monitored that the capacity Q of the indoor unit currently turned on changes; if they are the same, then it is determined whether the cumulative operation duration of the combination manner currently in operation has reached the preset duration such that if so, the next combination manner is operated, and if not, the current combination manner continues to be operated; if they are different, then a new combination manner is calculated according to the capacity Q of the current indoor unit, and it is determined whether the new combination manner is the same as the combination manner currently in operation; if they are the same, it is determined whether the accumulated operation duration has reached the preset duration; if it is reached, the next combination manner will be operated; if it is not reached, the new combination manner will continue to be operated; if they are different, the operation will be switched to a new combination manner.

The present disclosure also provides a MSAC system, comprising the combination and rotating operation device of outdoor units introduced previously, which may be provided in the MSAC system to control a combination and rotating operation of the outdoor units.

By applying a combination and rotation solution of the outdoor unit according to the present disclosure, an efficient combination manner of the outdoor unit is determined according to the capacity of the indoor unit currently turned on and the capacity of each outdoor unit, and an efficient rotation solution of the combination manner is determined by sequencing in priority. It is possible to improve the energy efficiency of the system during operation at partial load, achieve the purpose of saving the operation cost whilst ensuring optimal cooling and heating effects, and prolong an effective service life of the unit.

As may be known from the above description, the core inventive gist created by the present disclosure is mainly to provide a solution of determining an energy-efficiency combination manner of the outdoor unit under different capacities of the indoor unit turned on and a solution of rotating operation, thereby improving the energy efficiency of the system during operation at partial load, achieving the purpose of saving the operation cost whilst ensuring optimal cooling and heating effects, and prolonging an effective service life of the unit.

It should be noted that in this text, the terms "comprise", "include" or any other variant thereof are intended to encompass non-exclusive inclusion, so that a process, method, object or device that includes a series of elements includes not only those elements, but also other elements that are not explicitly listed, or elements inherent to such process, method, object, or device. Without more restrictions, the elements defined by the phase "include one . . . " does not exclude that there are other identical elements in the process, method, article or device that includes the element.

The serial numbers of the above-described embodiments of the present disclosure which are for description only, do not represent the advantages and disadvantages of the embodiments.

By the description of the above embodiments, those skilled in the art may clearly understand that the methods in the above-described embodiments may be implemented by means of software plus a necessary general hardware platform, and of course, may also be implemented by hardware. However, in many cases, the former is better embodiment. Based on such understanding, the technical solution of the present disclosure may be embodied in the form of a software product in essence or technical contribution parts. The computer software product which is stored in a storage medium (such as ROM/RAM, magnetic disk and optical disk), includes several instructions to enable a mobile terminal (which may be a mobile phone, computer, server, air conditioner, or network device and the like) to implement the methods described in the embodiments of the present disclosure.

The embodiments of the present disclosure have been described above in conjunction with the accompanying drawings. However, the present disclosure is not limited to the above-described specific embodiments. The above-described specific embodiments are only schematic, but not restrictive. With the inspiration of the present disclosure, those of ordinary skill in the art may also take many forms which all fall within the protection of the present disclosure, without departing from the spirit of the present disclosure and the scope of protection of the claims.

What is claimed is:

1. A method of combining outdoor units and rotating operation of the outdoor units, comprising:

determining a plurality of combination manners of the outdoor units, according a capacity of an indoor unit currently turned on and a capacity of each of the outdoor units;

sequencing the plurality of combination manners in priority, according to priority strategies; and sequentially rotating the outdoor units to operate, based on the sequenced combination manners;

wherein the determining the plurality of combination manners of the outdoor units, according to the capacity of the indoor unit currently turned on and the capacity of each of the outdoor units comprises:

determining a range of a total capacity of the outdoor units according to the capacity of the indoor unit currently turned on; and determining the plurality of combination manners of the outdoor units, according to the range of the total capacity of the outdoor units and the capacity of each of the outdoor units;

wherein the determining the range of the total capacity of the outdoor units, according to the capacity of the indoor unit currently turned on is achieved by the following formula:

$Q/b \leq Qcb \leq Q/a$, where Q is the capacity of the indoor unit currently turned on, Qcb is the total capacity of the outdoor units, a and bare preset values, $0<a<b<1$.

2. The method according to claim 1, wherein the determining the plurality of combination manners of the outdoor units, according to the range of the total capacity of the outdoor units and the capacity of each of the outdoor units comprises:

determining the capacity of each of the outdoor units;

using any one or more outdoor units to obtain the plurality of combination manners; and calculating a sum of capacities of outdoor units in each of the combination manners, determining a combination manner in which the sum of capacities of outdoor units is within the range of the total capacity of the outdoor units as a final combination manner of the outdoor units.

3. The method according to claim 1, wherein the priority strategies comprise:

setting a priority of a combination manner with minimum number of outdoor units to the highest; and if there are a plurality of combination manners that satisfy the minimum number of the outdoor units, calculating a sum of capacities of outdoor units in each of the combination manners, and setting a priority of a combination manner with a maximum sum of capacities of outdoor units to the highest;

if there are a plurality of combination manners that satisfy the minimum number of outdoor units and the maximum sum of capacities of outdoor units, setting a priority of a combination manner with a minimum communication address of outdoor units to the highest.

4. The method according to claim 1, further comprising:

supplementing outdoor units that are not involved in any combination manner into each of the combination manners according to sequencing strategies to form a plurality of new combination manners, after sequencing the plurality of combination manners in priority according to the priority strategies, wherein:

each of the new combination manners involves all the outdoor units;

in the new combination manners, a sequence of the outdoor units that are not involved is located after the outdoor units that have been involved; and the sequencing strategies comprises: sequencing in a descending order according to capacity; and sequencing in an ascending order according to communication address, if the capacity is the same.

5. The method according to claim 1, wherein the rotating the outdoor units to operate, based on the sequenced combination manners comprises:

sequentially operating each of the outdoor units in each of the combination manners according to a sequence, wherein an operation duration of each outdoor unit is a preset duration; and after the plurality of combination manners have been completed in operation, sequentially operating each of the outdoor units in each of the combination manners again and continuing such cycle until shutdown.

6. The method according to claim 5, further comprising:

when it is monitored that a current capacity Q of the indoor unit currently turned on changes, determining whether the current capacity Q of the indoor unit is the same as a capacity Q' of an indoor unit turned on at a previous moment;

if the current capacity Q of the indoor unit is the same as the capacity Q' of the indoor unit turned on, determining whether a cumulative operation duration of a combination manner currently in operation has reached the preset duration, if so, operating a next combination manner, and if not, continuing operating the combination manner currently in operation; and if the current capacity Q of the indoor unit is different from the capacity Q' of the indoor unit turned on, calculating a new combination manner according to the current capacity Q of the indoor unit, and determining whether the new combination manner is the same as the combination manner currently in operation, if the new combination manner is the same as the combination manner currently in operation, determining whether the cumulative operation duration has reached the preset duration, if it is reached, operating the next combination manner, and if it is not reached, continuing to operate the new combination manner, and if the new combination manner is different from the combination manner currently in operation, switching to operate the new combination manner.

7. A combination and rotating operation device of outdoor units, comprising:

a memory; and a processor coupled to the memory, wherein the processor is configured to perform the method of combining outdoor units and rotating operation of outdoor units according to claim 1 based on instructions stored in the memory.

8. A non-transitory computer-readable storage medium on which a computer program is stored, wherein the program when executed by a processor implements the method of combining outdoor units and rotating operation of outdoor units according to claim 1.

9. A device of combining outdoor units and rotating operation of the outdoor units comprising:

a combination module configured to determine a plurality of combination manners of the outdoor units according to a capacity of an indoor unit currently turned on and a capacity of each of the outdoor units;

a sequencing module configured to sequence the plurality of combination manners in priority according to priority strategies; and an operation module configured to sequentially rotate the outdoor units to operate based on the sequenced combination manner;

the combination module comprising:

a range determining unit configured to determine a range of a total capacity of the outdoor units according to a capacity of the indoor unit currently turned on; and a combination determining unit configured to determine the plurality of combination manners of the outdoor units according to the range of the total capacity of the outdoor units and the capacity of each of the outdoor units;

wherein the range determining unit determines a range of the total capacity Qcb of the outdoor units by the following formula:

$Q/b \leq Qcb \leq Q/a$, where Q is the capacity of the indoor unit currently turned on, Qcb is the total capacity of the outdoor units, a and bare preset values, $0<a<b<1$.

10. The device according to claim 9, wherein the combination module comprises:

a capacity determining unit configured to determine a capacity of each of the outdoor units;

a combination unit configured to use any one or more outdoor units to obtain the plurality of combination manners; and a selecting unit configured to calculate a sum of capacities of outdoor units in each of the combination manners, and to determine a combination manner in which the sum of capacities of outdoor units is within the range of the total capacity of the outdoor units as a final combination manner of the outdoor units.

11. The device according to claim 9, wherein the priority strategies comprises:

setting a priority of a combination manner with minimum number of outdoor units to the highest; and if there are a plurality of combination manners that satisfy the minimum number of the outdoor units, calculating a sum of capacities of outdoor units in each of the combination manners, and setting a priority of a combination manner with a maximum sum of capacities of outdoor units to the highest;

if there are a plurality of combination manners that satisfy the minimum number of outdoor units and the maximum sum of capacities of outdoor units, setting a priority of a combination manner with a minimum communication address of outdoor units to the highest.

12. The device according to claim 9, wherein the device further comprises:

a combination optimizing module configured to supplement outdoor units that are not involved in any combination manner into each of the combination manners according to sequencing strategies to form a plurality of new combination manners, wherein:

each of the new combination manners involves all the outdoor units;

in the new combination manners, a sequence of the outdoor units that are not involved is located after the outdoor units that have been involved, and the sequencing strategies comprise: sequencing in a descending order according to capacity; and sequencing in an ascending order according to communication address, if the capacity is the same.

13. The device according to claim 9, wherein the operation module is configured to sequentially operate each of the outdoor units in each of the combination manners, according to a sequence, wherein an operation duration of each of the outdoor units is a preset duration, after the plurality of combination manners have been completed in operation, to sequentially operate each of the outdoor units in each of the combination manners again, and to continue such cycle until shutdown.

14. The device according to claim 13, further comprising a monitoring operation module configured such that:

when it is monitored that a current capacity Q of the indoor unit currently turned on changes, determining whether the current capacity Q of the indoor unit is the same as a capacity Q' of an indoor unit turned on at a previous moment;

if the current capacity Q of the indoor unit is the same as the capacity Q' of the indoor unit turned on, determining whether a cumulative operation duration of a combination manner currently in operation has reached the preset duration, if so, operating a next combination manner, and if not, continuing to operate the combination manner currently in operation; and if the current capacity Q of the indoor unit is different from the capacity Q' of the indoor unit turned on, calculating a new combination manner according to the current capacity Q of the indoor unit, and determining whether the new combination manner is the same as the combination manner currently in operation, if the new combination manner is the same as the combination manner currently in operation, determining whether the cumulative operation duration has reached the preset duration, if it is reached, operating the next combination manner, and if it is not reached, continuing to operate the new combination manner, and if the new combination manner is different from the combination manner currently in operation, switching to operate the new combination manner.

15. A MSAC (multiple-split air conditioning) system, comprising the device of combining outdoor units and rotating operation of outdoor units according to claim 9.

* * * * *